United States Patent [19]

Brasell

[11] Patent Number: 4,897,524

[45] Date of Patent: Jan. 30, 1990

[54] PORTABLE ELECTRIC FIREPLACE WITH SIMULATED CHIMNEY FLUE

[76] Inventor: James M. Brasell, 16707 Waycreek Dr., Houston, Tex. 77068

[21] Appl. No.: 315,481

[22] Filed: Feb. 27, 1989

[51] Int. Cl.[4] ..... H05B 1/00; F24H 3/02

[52] U.S. Cl. ..... 219/344; 219/366; D23/335

[58] Field of Search ..... 219/344, 366, 373; 126/500, 521, 522, 523; D23/317, 330, 332, 335, 346, 393, 394

[56] References Cited

U.S. PATENT DOCUMENTS

| | | | |
|---|---|---|---|
| 524,714 | 8/1894 | Graves | 126/500 |
| 1,867,740 | 7/1932 | Guy | 219/344 |
| 3,636,307 | 1/1972 | Pearce | 219/344 |
| 3,742,189 | 6/1973 | Conroy et al. | 126/521 |
| 3,842,821 | 10/1974 | Juris | 219/344 |
| 4,008,705 | 2/1977 | Robertson | 126/500 |

*Primary Examiner*—A. D. Pellinen
*Assistant Examiner*—Geoffrey S. Evans
*Attorney, Agent, or Firm*—Neal J. Mosely

[57] ABSTRACT

A portable electric fireplace constructed of lightweight sheet metal has a hollow hearth section, canopy section, and a simulated chimney flue pipe and back plate. The hearth section has a rear wall, side walls, and a front wall with an opening therethrough which receives an electric heater and fan unit. The rear wall of the hearth section, canopy section, chimney flue pipe and back plate of the elbow are substantially flat and coplaner. The hollow canopy section is removably mounted above the hearth section to overlie the upper end thereof and has a front wall extending beyond the hearth front wall with a heat deflector therebetween at the front end. The artificial chimney flue pipe and back plate is removably mounted on the wall of a room and the assembled canopy and hearth sections are placed against the lower portion of the chimney flue pipe and secured thereto. In one embodiment, the assembled fireplace may be placed substantially close against the wall of a room and simulates the appearance of a real fireplace having a chimney flue pipe extending through the room wall. In another embodiment, the coplaner back walls have an angular configuration whereby the assembled fireplace may be placed in the corner of a room. The fireplace assembly may easily be transported in the unassembled condition from room to room and easily installed by one person.

20 Claims, 2 Drawing Sheets

PORTABLE ELECTRIC FIREPLACE WITH SIMULATED CHIMNEY FLUE

BACKGROUND OF THE INVENTION

1. FIELD OF THE INVENTION

This invention relates generally to simulated fireplace asemblies, and more particularly to a portable electric fireplace having a simulated chimney flue.

2. BRIEF DESCRIPTION OF THE PRIOR ART

Electric heaters and fireplaces having components which simulate real wood burning fireplace are known in the art. Most of these types of heaters and fireplaces, once installed in a room, can not be easily moved due to their construction and fixed installation within room walls and/or ceilings. There are several patents which disclose articifial or simulated fireplaces of various construction.

Weaver, U.S. Pat. No. 1,010,101 discloses an electric fireplace which is built into the wall of a room and has no flue. A piece of artwork is mounted at the rear of the fire-box and illuminated by lights hidden in the logs and andirons Specht, U.S. Pat. No. 1,433,915 and Specht et al U.S. Pat. No. 1,475,088 disclose fireplace heaters which have no flue and utilize an electric heater hidden in simulated coals or logs and a hot-water radiator hidden behind the rear wall of the firebox or behind the mantle jambs respectively and connected to a water pipe extending upwardly from the floor.

Guy, U.S. Pat. No. 1,680,513 discloses a fireplace heater which has no flue and utilizes hidden electric lights and reflectors which illuminate a simulated bed of coals and small electric radiant heaters which are mounted in electrical sockets hidden behind the hood.

Maller, U.S. Pat. No. 2,468,217 discloses an electric heater which has no flue and is adapted to be installed in existing fireplaces or installed in a recess within a wall and surrounded with trim representing a fireplace structure. The heater may also be installed in a portable cabinet in which case the heater housing and rear compartment would be insulated on the outside.

Pierce, U.S. Pat. No. 3,636,307 discloses an electric artificial fireplace having a hearth section with a screen covered opening and a canopy section fastened there above to form air spaces between the front and sides of the hearth. The canopy includes an electric heater and a fan. Air is drawn through the screen and discharged through air spaces around the front and sides of the hearth. There is no chimney flue.

The present invention is distinguished by a lightweight portable electric fireplace having a hollow hearth section, canopy section, and a simulated chimney flue pipe and back plate. The hearth section has a rear wall, side walls, and a front wall with an opening therethrough which receives an electric heater and fan unit. The rear wall of the hearth section, canopy section, chimney flue pipe and back plate of the elbow are substantially flat and coplaner. The hollow canopy section is removably mounted above the hearth section to overlie the upper end thereof and has a front wall extending beyond the hearth front wall with a heat deflector therebetween at the front end. The artificial chimney flue pipe and back plate is removably mounted on the wall of a room and the assembled canopy and hearth sections are placed against the lower portion of the chimney flue pipe and secured thereto. In one embodiment, the assembled fireplace may be placed substantially close against the wall of a room and simulates the appearance of a real fireplace having a chimney flue pipe extending through the room wall. In another embodiment, the coplaner back walls have an angular configuration whereby the assembled fireplace may be placed in the corner of a room. The fireplace assembly may easily be transported in the unassembled condition and installed by one person.

SUMMARY OF THE INVENTION

It is therefore an object of the present invention to provide a lightweight portable electric fireplace which may be easily transported in the unassembled condition from room to room and easily installed by one person.

It is another object of this invention to provide a portable electric fireplace which may be placed substantially close against the wall of a room and simulates the appearance of a real fireplace having a chimney flue pipe extending through the room wall.

Another object of this invention is to provide a portable electric fireplace which may be placed in the corner of a room and simulates the appearance of a real fireplace having a chimney flue pipe extending through the room wall.

Another object of this invention is to provide a portable electric fireplace which is quickly and easily assembled and disassembled with a common screwdriver.

A further object of this invention is to provide a portable electric fireplace which does not require any modification of existing room construction for its installation.

A still further object of this invention is to provide a portable electric fireplace which is simple in construction, attractive in appearance, economical to manufacture, and rugged and durable in use.

Other objects of the invention will become apparent from time to time throughout the specification and claims as hereinafter related.

The above noted objects and other objects of the invention are accomplished by a lightweight portable electric fireplace having a hollow hearth section, canopy section, and a simulated chimney flue pipe and back plate. The hearth section has a rear wall, side walls, and a front wall with an opening therethrough which receives an electric heater and fan unit. The rear wall of the hearth section, canopy section, chimney flue pipe and back plate of the elbow are substantially flat and coplaner. The hollow canopy section is removably mounted above the hearth section to overlie the upper end thereof and has a front wall extending beyond the hearth front wall with a heat deflector therebetween at the front end. The artificial chimney flue pipe and back plate is removably mounted on the wall of a room and the assembled canopy and hearth sections are placed against the lower portion of the chimney flue pipe and secured thereto. In one embodiment, the assembled fireplace may be placed substantially close against the wall of a room and simulates the appearance of a real fireplace having a chimney flue pipe extending through the room wall. In another embodiment, the coplaner back walls have an angular configuration whereby the assembled fireplace may be placed in the corner of a room. The fireplace assembly may easily be transported in the unassembled condition from room to room and easily installed by one person.

DESCRIPTION OF THE PREFERRED EMBODIMENT

Figure 3:
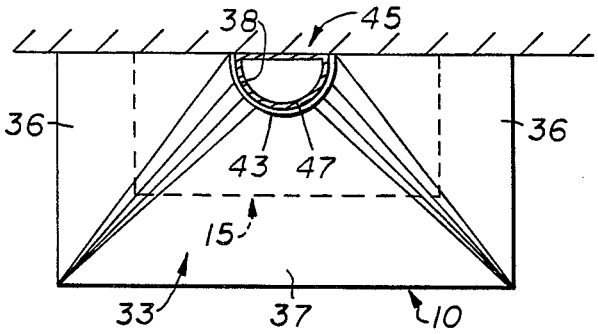
FIG. 3 is a top view in cross section along line 3—3 of FIG. 1.
Figure 5:
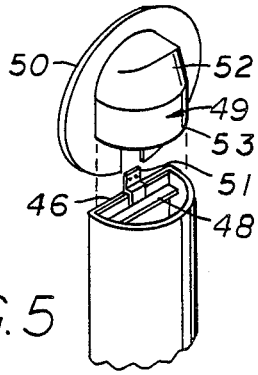
FIG. 5 is an exploded isometric view of the top portion of the chimney flue pipe.
Figure 1:
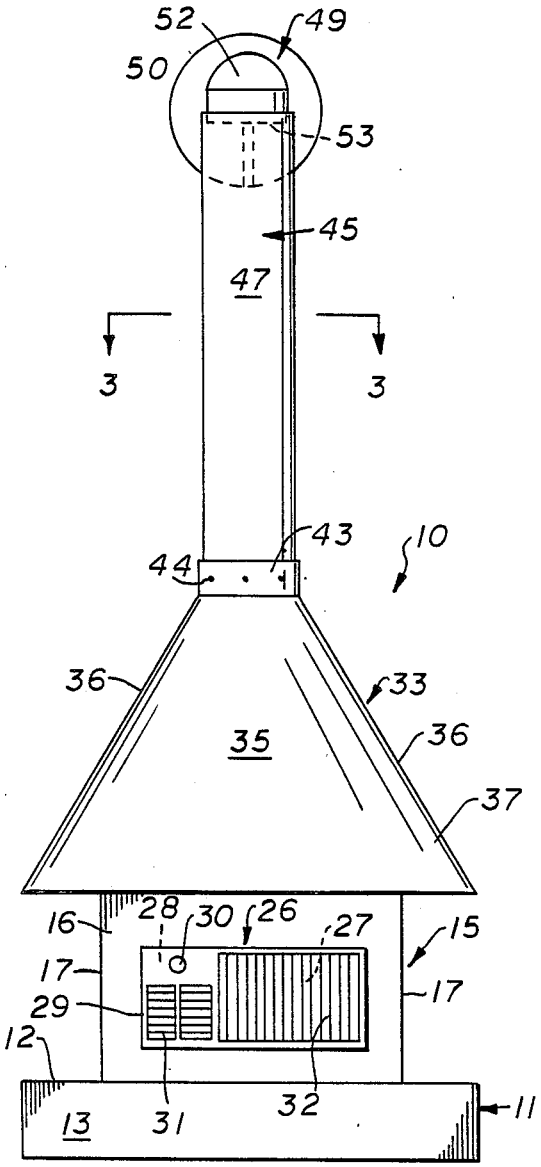
FIG. 1 is a front elevation of an embodiment of the portable electric fireplace with imitation chimney flue which may be installed against the wall of a room.
Figure 2:
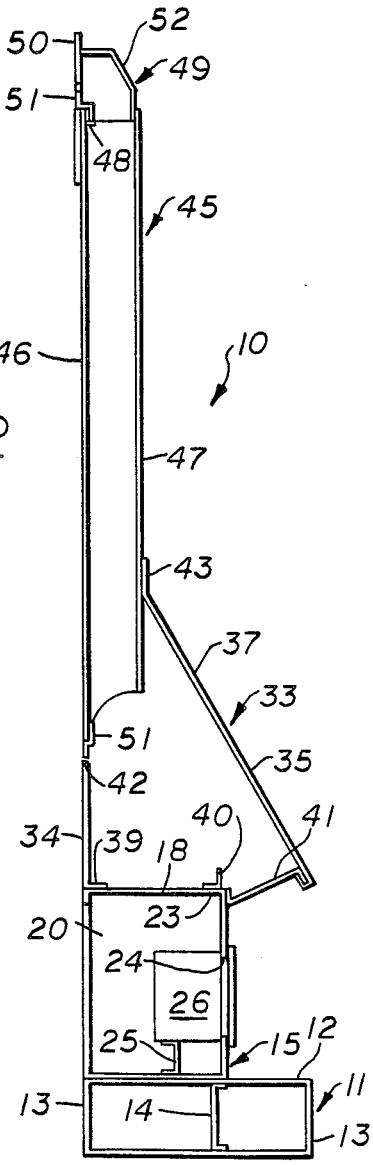
FIG. 2 is a side elevation in cross section of the portable electric fireplace of FIG. 1.
Figure 8:
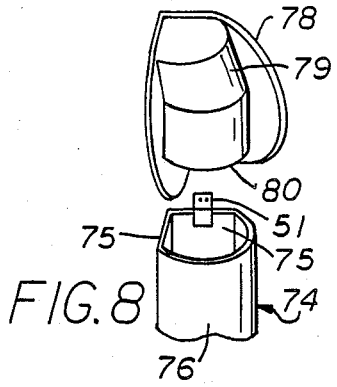
FIG. 8 is an exploded isometric view of the top portion of the chimney flue pipe of the embodiment of FIG. 6.

Referring to the drawings by numerals of reference, there is shown in FIGS. 1-5, a preferred portable electric fireplace 10 The fireplace 10 has a hollow square or rectangular box-like base or pedestal 11 having a top wall 12 and side walls 13. The pedestal 11 is formed of lightweight sheet metal. A channel member 14 extends from side to side inside the pedestal for structural rigidity and strength.

A hearth section 15 is secured to the top wall 12 of the pedestal 11. The hearth section 15 is a square or rectangular configuration having a U-shaped, transverse cross section with a front wall 16 and opposing side walls 17 and an open top end 18, bottom end 19, and back end 20. The peripheral edges of the front wall 16 and side walls 17 are bent inward to form flanges 21 at each lateral side of the open back, a bottom flange 22 around the open bottom end, and a top flange 23 around the open top end. Holes are provided through the top flange for receiving sheet metal screws (not shown).

The hearth section 15 is attached to the platform 11 by securing the bottom flange 22 of the hearth section to the top wall 12 of the platform by conventional means such as riveting, spot welding, or through bolting. A central opening 24 is provided in the hearth front wall 16 and holes (not shown) are provided along the opening for securing an electric heater and fan unit therein. A channel member 25 extends from side to side inside the hearth section 15 for structural rigidity and strength and for supporting the electric heater and fan unit thereon as described hereinafter.

An electric heater and fan unit 26 is secured within the opening 24. The electric heater and fan unit 26 has an insulated housing which contains electric heating elements 27 and a fan 28 at one side thereof for drawing air into the housing and discharging it across the heating elements. A removable front panel 29 covers the front of the heater and fan unit and has one or more heater control knobs 30, a series of louvers 31 at one side for conducting air in and a series of larger louvers 32 for directing the heated the air into the room in which the fireplace is placed. The heater and fan unit 26 is installed by removing the front panel 29, inserting the heater and fan housing through the open back 20, placing the front panel 29 on the front wall 16 and securing the panel to the heater and fan housing with screws through the front wall of the hearth section.

A hollow hood or canopy 33 is releasably fastened to the hearth section 15. The canopy 15 has a vertical flat back wall 34, and a hood portion 35 secured thereto which is bent to form triangularly shaped side walls 36 and an inclined front wall 37. The top of the canopy 33 when viewed from the top (FIG. 3) is formed into a semi-circular configuration and the flat back wall 34 completes the semi-circular top portion to form a substantially D-shaped opening 38. The bottom edges of the canopy 33 are bent inward to form structurally reinforcing flanges 39 and eliminate sharp edges. A channel member 40 extends from side to side inside the canopy 15 for structural rigidity and strength and for supporting the canopy on the hearth section 15.

The channel member 40 is removably secured to the top flange 23 of the hearth section 15 by screws and the back wall 34 of the canopy is removably secured to the top flange 23 at the sides of the hearth section by screws through the back wall bottom flange 39.

When properly assembled, the lower edge of the canopy front wall 37 is spaced forwardly from the front wall 16 of the hearth section 15 and the lower ends of the canopy side walls 36 are spaced laterally outward from the side walls 17 of the hearth section, such that the canopy overlaps or extends beyond front and side walls of the hearth section. The vertical back wall 34 of the canopy 33 is substantially aligned with the back wall of the pedestal 11 so that the assembly may be placed flush against the wall of a room.

A rectangular heat shield or deflector 41 extends tranversly across the front of the hearth section front wall 16 above the heater unit 26 and is secured at one side edge to the inside lower end flange 39 of the canopy front wall 37 and its other side edge is releasably fastened to the front wall 16 of the hearth section 15 by screws. The heat deflector 41 further supports the front of the canopy and serves as a heat deflector to prevent heated air from entering the canopy and to direct the heated air into the room from the front of the fireplace.

The back wall 34 of the canopy 33 is provided with a rectangular opening 42 which extends downward a distance from the D-shaped top portion. A C-shaped collar 43 is secured to the semi-circular top of the hood portion 33 to partially surround the D-shaped opening and is provided with a plurality of radially spaced holes which receive screws 44.

An elongate section of chimney flue pipe 45 has a vertical flat back wall 46, and a semi-circular front wall 47 secured thereto which forms a substantially D-shaped configuration in transverse cross section. An angle bracket 48 may be secured in the top and bottom ends of the flue pipe to reinforce the structure. One or more mounting clips 51 are secured to the top and bottom of the back wall 46 by riveting, welding, or screws and extend longitudinally outward therefrom and have holes in the extended end for mounting the chimney flue pipe 45 in a vertical position on the wall with screws. The chimney flue pipe 45 may be provided in predetermined lengths for conventional wall heights or additional sections may be provided for other installations.

An imitation pipe elbow 49 formed of sheet metal is removably received in the top of the D-shaped chimney flue pipe 45. The pipe elbow 49 comprises a flat circular back plate 50 having a slot therein for receiving the mounting clips 51 which extend from the top of the flue pipe back wall 47. A small bent hood portion 52 is secured to the back plate 50 and curves outwardly and downwardly therefrom and terminates in a semi-circular bottom edge 53 which is slightly smaller in radial dimension to be slidably received within the top of the D-shaped flue pipe 45.

To install the fireplace, the D-shaped chimney flue pipe 45 with the pipe elbow 49 in the top thereof is place against the wall and moved vertically to obtain the desired height. A level may be placed alongside the pipe to assure a vertical position. The elbow 49 is removed, and the mounting screw locations are marked through the holes in the mounting clips 51. Screws are installed through the holes in the mounting clips 51 to secure the pipe 45 to the wall. The preassembled hearth and canopy assembly is then moved against the wall with the lower portion of the chimney flue pipe 45 received through the slot 42 in the canopy back wall 34 and the curved wall 47 of the pipe 45 received within the collar 43 of the canopy. The canopy is then secured to the chimney flue pipe 45 by screws 44.

The portable electric fireplace 10 is constructed of lightweight sheet metal and may easily be transported in the unassembled or semi-assembled condition from room to room by one person and requires no hook-up or installation other than mounting the flue pipe and placing the hearth and canopy assembly against a flat wall and plugging the electric heater cord into a conventional 120 v. AC electric wall recepticle.

ANOTHER EMBODIMENT

In the following description, components and features which have been previously described with reference to FIGS. 1–5 are assigned the same numerals of reference and the complete description of some components may not be repeated to avoid repetition.

Figure 7:
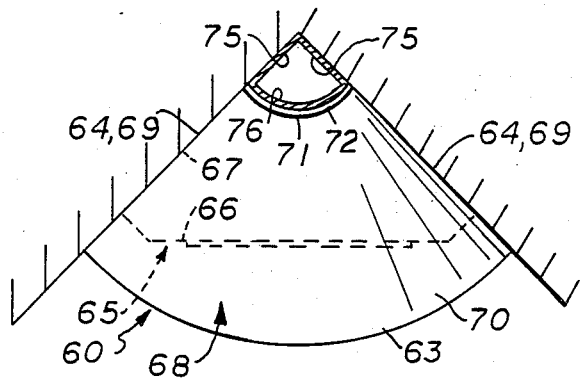
FIG. 7 is a top view in cross section along line 7—7 of FIG. 6.
Figure 4:
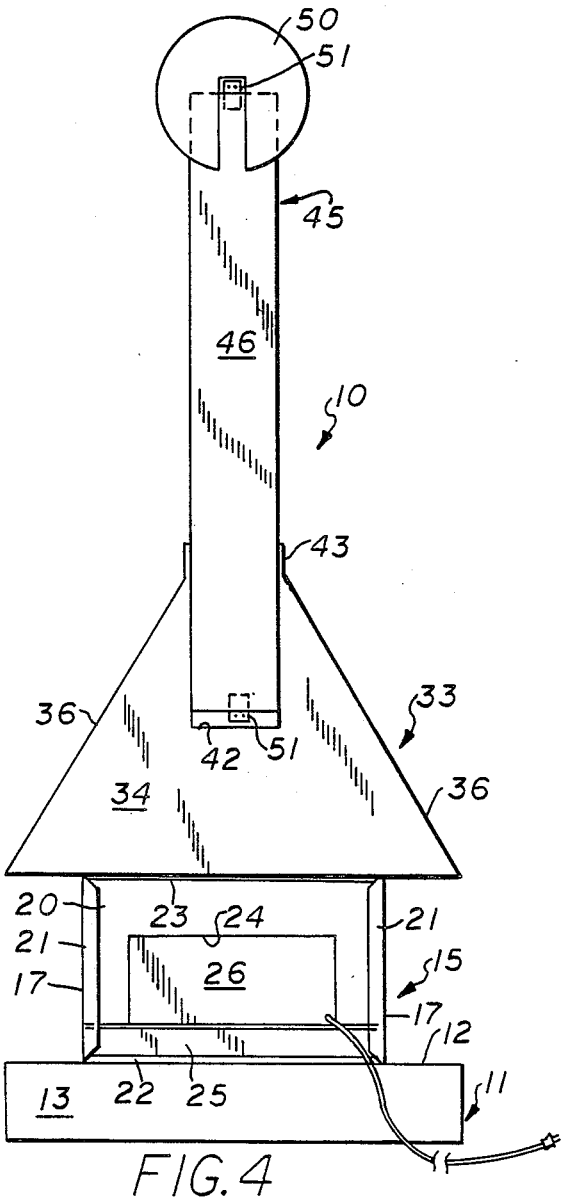
FIG. 4 is a rear elevation of the portable electric fireplace of FIG. 1.
Figure 6:
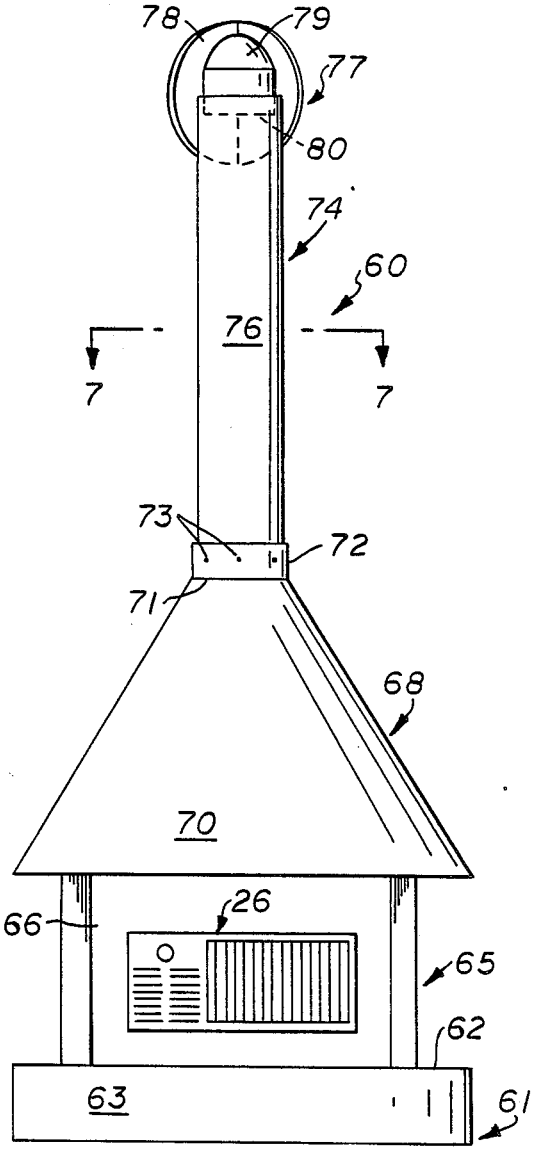
FIG. 6 is a front elevation of another embodiment of the portable electric fireplace with imitation chimney flue which may be installed in the corner of a room.

Another embodiment of the portable electric fireplace in accordance with the present invention is configured to fit into the corner of a room is shown in FIGS. 6 and 7. The corner fireplace 60 has a hollow pie-shaped or triangular box-like base or pedestal 61 having a top wall 62, a curved front wall 63, and rearwardly converging side walls 64. The pedestal 61 is formed of lightweight sheet metal. A channel member may extend from side to side inside the pedestal for structural rigidity and strength.

A hearth section 65 is secured to the top wall 62 of the pedestal 61. The hearth section 65 has a generally triangular shaped transverse cross section with a front wall 66 and rearwardly converging side walls 67. As previously described, the hearth section has an open top, bottom, and back end and the peripheral edges of the front and side walls are bent inward to form flanges at each side of the open back, a bottom flange around the open bottom end, and a top flange around the open top end. Holes are provided through the top flange for receiving sheet metal screws, and the hearth section 61 is attached to the platform 61 in the manner previously described. The electric heater and fan unit 26 is also installed in an opening in the hearth section front wall and supported therein as previously described.

A hollow hood or canopy 68 is releasably fastened to the hearth section 65. The canopy 68 has a vertical back wall 69 bent along its vertical axis at an angle corresponding the corner of the room, such as approximately 90', and a conical hood portion 70 secured thereto which is bent or curved to form a truncated conical front wall. The top of the canopy 68 when viewed from the top (FIG. 7) is formed into a semi-circular configuration and the angular back wall 69 completes the semi-circular portion to form a substantially pie-shaped opening 71. As previously described, the bottom edges of the canopy 68 are bent inward to form structurally reinforcing flanges and eliminate sharp edges and a channel member extends from side to side inside the canopy for structural rigidity and strength and for supporting the canopy on the hearth section.

When properly assembled, the lower edge of the canopy front wall 70 is spaced radially from the front wall 66 of the hearth section 65, such that the canopy lower section extends radially beyond the hearth section. The angular vertical back wall 69 of the canopy 68 is substantially aligned with the converging side walls 64 of the pedestal 61 so that the assembly may be placed flush in the corner of a room.

The angular back wall 69 of the canopy 68 is provided with a rectangular opening or slot which extends downward a distance from the pie-shaped top opening 71. An arcuate collar 72 is secured to the semi-circular top of the hood portion 70 to partially surround the pie-shaped opening 71 and is provided with a plurality of radially spaced holes which receive screws 73.

An elongate section of chimney flue pipe 74 has an angular back wall 75, and a semi-circular front wall 76 secured thereto which forms a substantially pie-shaped configuration in transverse cross section. As previously described, an angle bracket may be secured in the top and bottom ends of the flue pipe to reinforce the structure and one or more mounting clip are secured to the top and bottom ends of the flue pipe 74 for mounting the pipe 74 in a vertical position in the corner of a room. The chimney flue pipe may be provided in predetermined lengths for conventional wall heights or additional sections may be provided for other installations.

An imitation pipe elbow 77 formed of sheet metal is removably received in the top of the pie-shaped chimney flue pipe 74. The pipe elbow 77 comprises a circular back plate 78 bent at an angle and has a pair of slots for receiving the mounting clips that extend upwardly from the top of the flue pipe back wall 75. A small bent hood portion 79 is secured to the back plate 78 and curves outwardly and downwardly therefrom and terminates in a pie-shaped bottom edge 80 which is slightly smaller in radial dimension to be slidably received within the top of the pie-shaped flue pipe 74.

The chimney flue pipe 74 is mounted vertically in the corner of the room in the manner previously described with the flat wall version and the preassembled hearth and canopy assembly is then moved into the corner with the lower portion of the chimney flue pipe 74 received through the slot in the canopy back wall and the arcuate wall of the pipe received within the collar of the canopy. The canopy is then secured to the chimney flue pipe by screws 73.

While this invention has been described fully and completely with special emphasis upon a preferred embodiment, it should be understood that within the scope of the appended claims the invention may be practiced otherwise than as specifically described herein.

I claim:

1. A portable electric fireplace of lightweight construction comprising;

a hollow hearth section having rear wall, side walls, and a front wall with an opening therethrough for receiving electric heater means, a hollow canopy section removably mounted above said hearth section to overlie the upper end thereof and having a front wall extending beyond said hearth front wall, a rear wall substantially coplaner with said hearth rear wall, and an upper end adapted to removably receive an artificial chimney flue pipe, an elongate artificial chimney flue pipe having a front wall, a rear wall, and top and bottom ends and adapted at its top and bottom ends to be removably secured on the surface of a wall, an imitation pipe elbow removably received at one end in the top end of said chimney flue pipe and having a back plate at its other end substantially coplaner with said chimney flue pipe back wall to reside against the surface of the wall, whereby the assembled hearth section and canopy section may be removably placed substantially close against the wall of a room and the lower portion of said chimney flue pipe received the within said canopy section extending upwardly therefrom and the assembly simulating the appearance of a real fireplace having a chimney flue pipe extending through the room wall.

2. The portable electric fireplace according to claim 1 wherein said hearth section includes a platform portion secured at its bottom end and having a front wall extending beyond said hearth front wall, a rear wall substantially coplaner with said hearth rear wall, and side walls extending laterally beyond said hearth side walls.

3. The portable electric fireplace according to claim 1 wherein said chimney flue pipe back wall is adapted at it top and bottom ends to receive mounting means for removably securing same to the wall of a room in a vertical position suspended above the floor of the room.

4. The portable electric fireplace according to claim 1 including an electric heater and fan unit removably secured within the opening of said hearth front wall.

5. The portable electric fireplace according to claim 4 wherein said electric heater and fan unit has an insulated housing which contains electric heating elements and a fan disposed relative thereto for drawing air into the housing and discharging it across the heating elements and into the room.

6. The portable electric fireplace according to claim 5 including a heat deflector extending outwardly between said hearth front wall and the lower end of the front wall of said canopy to prevent discharged heated air from entering said canopy and to direct it into the room.

7. The portable electric fireplace according to claim 6 wherein said electric heater and fan unit has a removable front panel which covers the front of the heater and fan unit and has one or more heater control knobs, a plurality of louvers for conducting air into the housing, and a plurality of louvers for directing the heated the air into the room in which the fireplace is positioned.

8. The portable electric fireplace according to claim 1 wherein said chimney flue back wall is flat and its front wall is semi-circular to form a generally D-shaped transverse cross section, said canopy section back wall is flat and has a rectangular opening which extends downward a distance from the top end and the upper end of said canopy front wall has an upstanding semi-circular collar portion, and the lower portion of said chimney flue pipe is received within the slotted opening with its back wall substantially coplaner with said canopy section back wall when said hearth and canopy sections are placed against the wall and its semicircular front wall is removably secured to said canopy collar portion, and said one end of said imitation pipe elbow removably secured in the top end of said chimney flue pipe is substantially D-shaped in tranverse cross section and is smaller in radial dimension to be slidably received in the top end of said chimney flue pipe.

9. The portable electric fireplace according to claim 1 wherein said chimney flue back wall is bent at an angle along its vertical axis and its front wall is semi-circular to form a generally pie-shaped transverse cross section, said canopy section back wall is bent at an angle along its vertical axis and has a rectangular opening which extends downward a distance from the top end and the upper end of said canopy front wall has an upstanding semi-circular collar portion, and the lower portion of said chimney flue pipe is received within the slotted opening with its back wall substantially coplaner with said canopy section back wall when said hearth and canopy sections are placed against the wall and its semi-circular front wall is removably secured to said canopy collar portion, said imitation pipe elbow removably secured in the top end of said chimney flue pipe is substantially pie-shaped in tranverse cross section and is smaller in radial dimension to be slidably received in the top end of said chimney flue pipe and said back plate at its other end is bent at an angle corresponding substantially to the back wall of said chimney flue pipe, whereby the assembled hearth section and canopy section may be removably placed substantially close against adjacent walls in the corner of a room and the lower portion of said chimney flue pipe received the within said canopy section extending upwardly therefrom and the assembly simulating the appearance of a real fireplace having a chimney flue pipe extending through the room wall.

10. The portable electric fireplace according to claim 1 wherein said hearth section, said canopy section, said chimney flue pipe and said elbow are constructed of lightweight sheet metal whereby said canopy section and said assembled hearth and canopy sections may easily be transported in a semi-assembled condition from room to room by one person.

11. The combination with a vertical interior wall of a room of a building of a portable electric fireplace of lightweight construction comprising;

a hollow hearth section having rear wall, side walls, and a front wall with an opening therethrough for receiving electric heater means, a hollow canopy section removably mounted above said hearth section to overlie the upper end thereof and having a front wall extending beyond said hearth front wall, a rear wall substantially coplaner with said hearth rear wall, and an upper end adapted to removably receive an artificial chimney flue pipe, an elongate artificial chimney flue pipe having a front wall, a rear wall, and top and bottom ends and adapted at its top and bottom ends to be removably secured on the surface of said vertical interior wall, an imitation pipe elbow removably received at one end in the top end of said chimney flue pipe and having a back plate at its other end substantially coplaner with said chimney flue pipe back wall to reside against the surface of said wall, whereby the assembled hearth section and canopy section is removably placed substantially close against said wall and the lower portion of said chimney flue pipe received the within said canopy section extending upwardly therefrom and the assembly simulating the appearance of a real fireplace having a chimney flue pipe extending through the room wall.

12. The portable electric fireplace combination with a wall according to claim 11 wherein said hearth section includes a platform portion secured at its bottom end and having a front wall extending beyond said hearth front wall, a rear wall substantially coplaner with said hearth rear wall, and side walls extending laterally beyond said hearth side walls.

13. The portable electric fireplace combination with a wall according to claim 11 wherein said chimney flue pipe back wall is adapted at it top and bottom ends to receive mounting means for removably securing same to said vertical wall suspended above the floor of the room.

14. The portable electric fireplace combination with a wall according to claim 11 including an electric heater and fan unit removably secured within the opening of said hearth front wall.

15. The portable electric fireplace combination with a wall according to claim 14 wherein said electric heater and fan unit has an insulated housing which contains electric heating elements and a fan disposed relative thereto for drawing air into the housing and discharging it across the heating elements and into the room.

16. The portable electric fireplace combination with a wall according to claim 15 including a heat deflector extending outwardly between said hearth front wall and the lower end of the front wall of said canopy to prevent discharged heated air from entering said canopy and to direct it into the room.

17. The portable electric fireplace combination with a wall according to claim 16 wherein said electric heater and fan unit has a removable front panel which covers the front of the heater and fan unit and has one or more heater control knobs, a plurality of louvers for conducting air into the housing, and a plurality of louvers for directing the heated the air into the room in which the fireplace is positioned.

18. The portable electric fireplace combination with a wall according to claim 11 wherein said chimney flue back wall is flat and its front wall is semi-circular to form a generally D-shaped transverse cross section, said canopy section back wall is flat and has a rectangular opening which extends downward a distance from the top end and the upper end of said canopy front wall has an upstanding semi-circular collar portion, and the lower portion of said chimney flue pipe is received within the slotted opening with its back wall substantially coplaner with said canopy section back wall when said hearth and canopy sections are placed against said vertical wall and its semi-circular front wall is removably secured to said canopy collar portion, and said one end of said imitation pipe elbow removably secured in the top end of said chimney flue pipe is substantially D-shaped in tranverse cross section and is smaller in radial dimension to be slidably received in the top end of said chimney flue pipe.

19. The portable electric fireplace combination with a wall according to claim 11 wherein said chimney flue back wall is bent at an angle along its vertical axis and its front wall is semi-circular to form a generally pie-shaped transverse cross section, said canopy section back wall is bent at an angle along its vertical axis and has a rectangular opening which extends downward a distance from the top end and the upper end of said canopy front wall has an upstanding semi-circular collar portion, and the lower portion of said chimney flue pipe is received within the slotted opening with its back wall substantially coplaner with said canopy section back wall when said hearth and canopy sections are placed against said vertical wall and and its semi-circular front wall is removably secured to said canopy collar portion, said imitation pipe elbow removably secured in the top end of said chimney flue pipe is substantially pie-shaped in tranverse cross section and is smaller in radial dimension to be slidably received in the top end of said chimney flue pipe and said back plate at its other end is bent at an angle corresponding substantially to the back wall of said chimney flue pipe, whereby the assembled hearth section and canopy section may be removably placed substantially close against adjacent walls in the corner of a room and the lower portion of said chimney flue pipe received the within said canopy section extending upwardly therefrom and the assembly simulating the appearance of a real fireplace having a chimney flue pipe extending through the room wall.

20. The portable electric fireplace combination with a wall according to claim 11 wherein said hearth section, said canopy section, said chimney flue pipe and said elbow are constructed of lightweight sheet metal whereby said canopy section and said assembled hearth and canopy sections may easily be transported in a semi-assembled condition from room to room by one person.

* * * * *